US010285507B2

(12) United States Patent
Guthrie et al.

(10) Patent No.: US 10,285,507 B2
(45) Date of Patent: May 14, 2019

(54) BED WITH A STOWABLE SIDERAIL

(71) Applicant: Hill-Rom Services, Inc., Batesville, IN (US)

(72) Inventors: Brian Guthrie, Greensburg, IN (US); Craig E. Koors, Greensburg, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 520 days.

(21) Appl. No.: 14/843,379

(22) Filed: Sep. 2, 2015

(65) Prior Publication Data

US 2017/0055717 A1 Mar. 2, 2017

Related U.S. Application Data

(60) Provisional application No. 62/210,006, filed on Aug. 26, 2015.

(51) Int. Cl.

| | |
|---|---|
| ***A47C 21/08*** | (2006.01) |
| ***A47C 27/08*** | (2006.01) |
| ***A47C 21/00*** | (2006.01) |
| ***A61G 7/05*** | (2006.01) |

(52) U.S. Cl.

CPC ..... *A47C 21/08* (2013.01); *A61G 7/051* (2016.11); *A61G 7/0515* (2016.11); *A61G 7/0519* (2016.11)

(58) Field of Classification Search

CPC ..... A47C 21/08; A47C 27/08; A47C 21/00; A61G 7/0507; A61G 7/0508; A61G 7/0515; A61G 7/051; A61G 7/0519

See application file for complete search history.

(56) References Cited

U.S. PATENT DOCUMENTS

| | | | | |
|---|---|---|---|---|
| 2,750,605 A * | 6/1956 | Blevins | A47C 21/08 5/100 |
| 3,855,654 A * | 12/1974 | Pivacek | A61G 7/0509 5/100 |
| 4,669,136 A * | 6/1987 | Waters | A61G 7/00 177/144 |
| 4,747,171 A * | 5/1988 | Einsele | A61G 7/0509 5/425 |
| 4,993,089 A * | 2/1991 | Solomon | A61G 7/0507 5/428 |

(Continued)

FOREIGN PATENT DOCUMENTS

DE 202010002856 U1 7/2010

OTHER PUBLICATIONS

European Search Report; Application 16184184.6-1651; Reference No. P/75628.EP01; dated Dec. 20, 2016.

(Continued)

*Primary Examiner* — Nicholas F Polito
*Assistant Examiner* — Rahib T Zaman
(74) *Attorney, Agent, or Firm* — Kenneth C. Baran

(57) ABSTRACT

A bed comprises a frame and a siderail assembly. The siderail assembly includes a noncollapsible siderail panel having an upper edge and a lower edge, a guide rail affixed to the panel and having an extension which extends past the lower edge of the panel, and a link rotatably mounted on the frame. The link is configured to receive the extension so that the link grips the extension but also permits translation of the guide rail relative to the link.

23 Claims, 20 Drawing Sheets

(56) References Cited

U.S. PATENT DOCUMENTS 6,360,385 B1 * 3/2002 Lewandowski ..... A61G 7/0507 5/428
6,446,283 B1 * 9/2002 Heimbrock ..... A61G 7/00 5/425
7,007,323 B2 * 3/2006 Zerhusen ..... A61G 7/05 5/424
7,028,352 B2 * 4/2006 Kramer ..... A61G 7/05 428/430
7,036,166 B2 * 5/2006 Kramer ..... A61G 7/015 5/617
7,805,782 B2 * 10/2010 Hakamiun ..... A61G 7/0507 5/428
7,913,334 B2 * 3/2011 Guguin ..... A61G 7/0507 5/100
7,917,978 B2 * 4/2011 Ruschke ..... A61G 7/0507 5/428
8,176,584 B2 * 5/2012 Hornbach ..... A61G 7/012 378/209
8,631,525 B2 * 1/2014 Flannery ..... A47C 21/08 5/425
9,622,927 B1 * 4/2017 Edgerton ..... A61G 7/002
2002/0020018 A1 * 2/2002 Heimbrock ..... A61G 13/0054 5/613
2004/0040092 A1 * 3/2004 Hensley ..... A61G 7/0507 5/600
2004/0128763 A1 * 7/2004 Nygren ..... A47C 21/08 5/426
2005/0166320 A1 * 8/2005 Lemire ..... A61G 7/0509 5/425
2006/0107460 A1 * 5/2006 Wiggins ..... A61G 7/0507 5/430
2009/0188042 A1 * 7/2009 Derenne ..... A61G 7/0507 5/430
2012/0073047 A1 * 3/2012 Wiggins ..... A61G 7/0507 5/428
2013/0097778 A1 * 4/2013 Serhan ..... A61G 7/0507 5/430
2013/0239327 A1 * 9/2013 Lemonnier ..... A61G 7/0507 5/428

OTHER PUBLICATIONS

Letter to European Patent Office dated Aug. 31, 2017 from Reddie & Grose; A communication pursuant to Rule 69 EPC; Bed with a Stowable Siderail of Hill-Rom Services, Inc.; Reference: P/75628.EP01/AF/nc.
P75628.EP01—Claims (final) Aug. 31, 2017; 3-pages; Claims 1-15.
P75628.EP01—Claims (track changes)—Aug. 31, 2017; 3-pages; Claims 1-15.
P75628.EP01—Amended pages (final)—Aug. 31, 2017; 4-pages—1,7, 8, & 9.
P75628.EP01—Amended pages (track changes)—Aug. 31, 2017; 9-pages—1, 1, 7-13.

* cited by examiner

BED WITH A STOWABLE SIDERAIL

TECHNICAL FIELD

The subject matter described herein relates to occupant supports such as beds and stretchers and particularly to an occupant support having a siderail which is stowable under an elevatable frame component of the occupant support.

SUMMARY

A bed comprises a frame and a siderail assembly which includes a noncollapsible siderail panel having an upper edge and a lower edge. The siderail assembly also includes a guide rail affixed to the panel and having an extension which extends past the lower edge of the panel. The siderail assembly also includes a link pivotably mounted on the frame. The link is configured to receive the extension so that the link grips the extension but also permits translation of the guide rail relative to the link.

BRIEF DESCRIPTION OF THE DRAWINGS

The foregoing and other features of the various embodiments of the bed and stowable siderail described herein will become more apparent from the following detailed description and the accompanying drawings in which.

DETAILED DESCRIPTION

Figure 1:
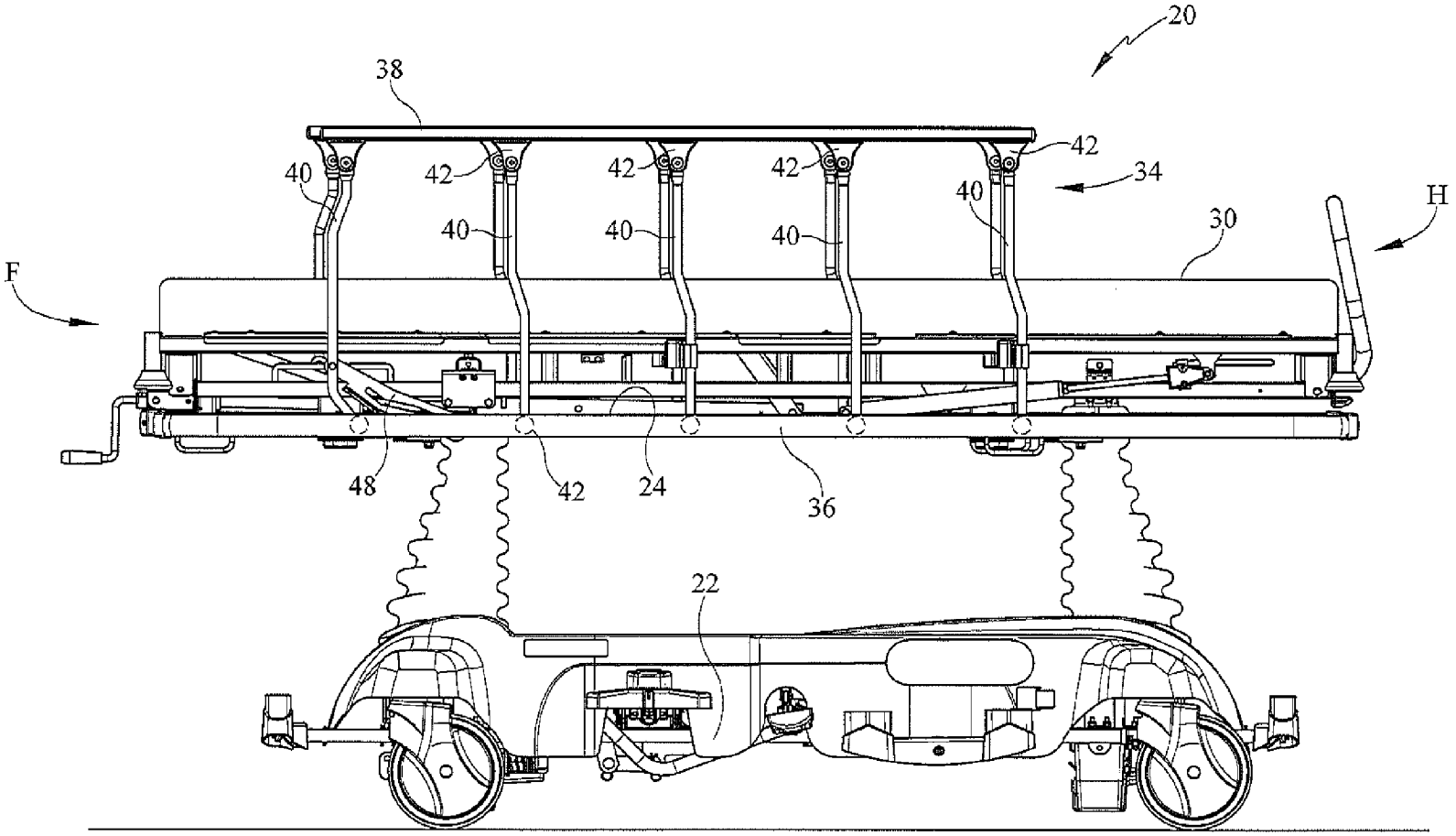
PRIOR ART FIG. 1
FIG. 1 is a view of a prior art stretcher having a collapsible siderail shown in its deployed position.

Occupant supports such as beds and stretchers include siderails to define the lateral edges of the occupant support. By way of example FIGS. 1-6 show a stretcher 20 extending longitudinally from a head end H to a foot end F and laterally from a left side L to a right side R. The stretcher has a framework comprised of a base frame 22 and an elevatable frame 24 connected to the base frame by a height adjustment mechanism, not shown. The height adjustment mechanism can be operated to change the elevation of the elevatable frame relative to the base frame. The illustrated stretcher also includes a deck 26 supported on the elevatable frame and a mattress 30 resting on the deck.

Figure 2:
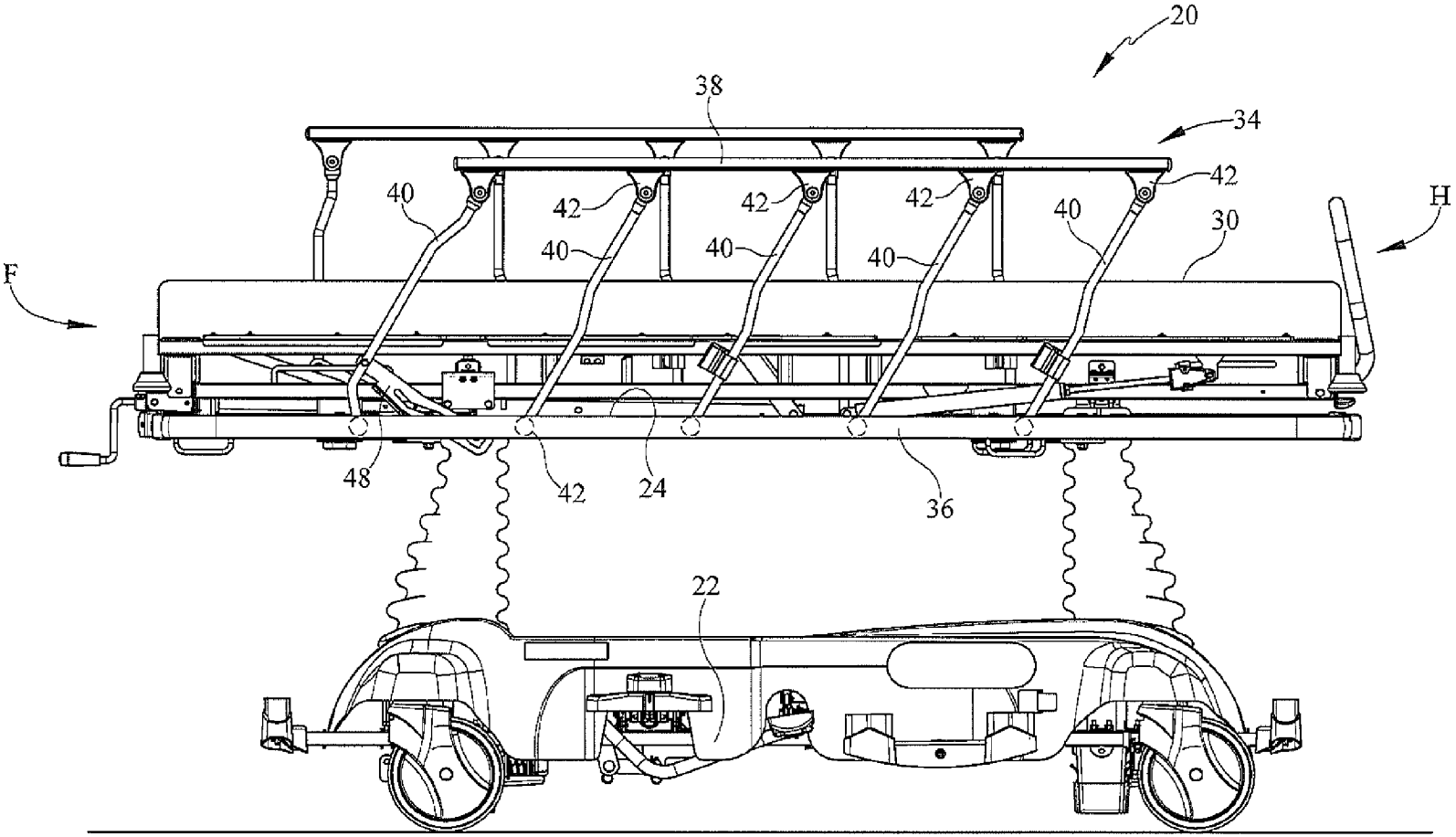
PRIOR ART FIG. 2
FIGS. 2, 3 and 4 are views similar to that of FIG. 1 showing the siderail partially collapsed, almost completely collapsed, and completely collapsed.
Figure 3:
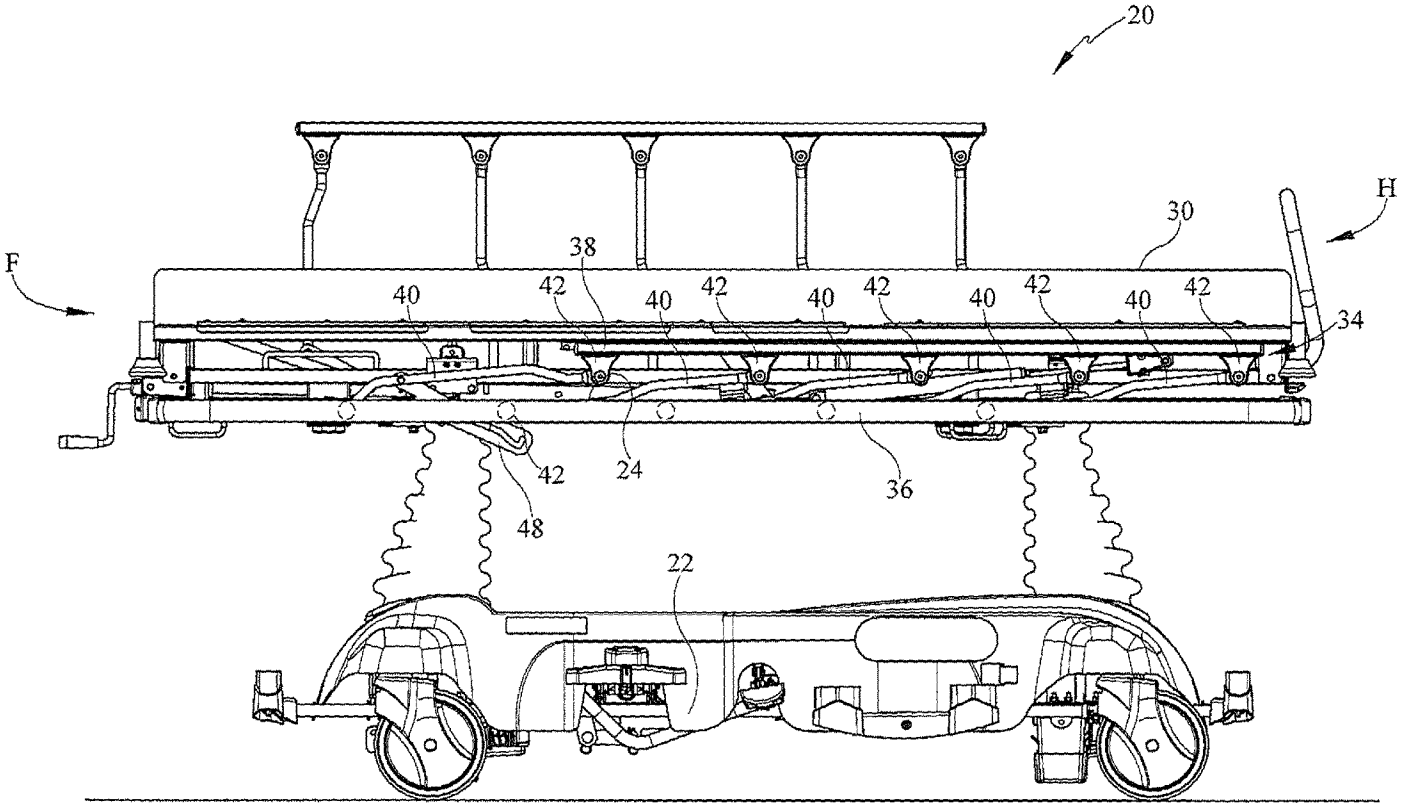
PRIOR ART FIG. 3
Figure 4:
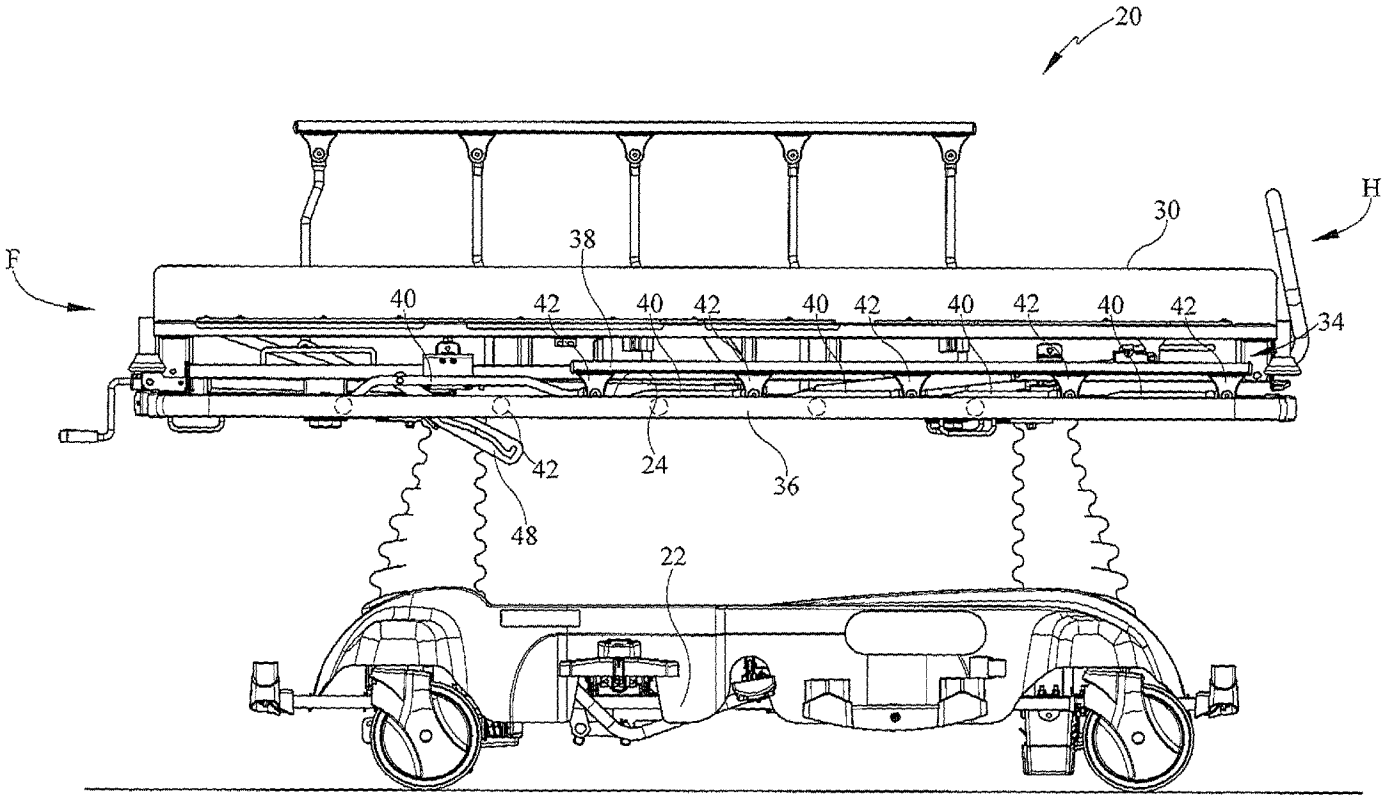
PRIOR ART FIG. 4

The stretcher also includes a siderail 34 having a bottom rail 36 affixed to the elevatable frame, a top rail 38 and a set of rods 40 extending between the top rail and the bottom rail to link the rails together. The links are connected to the top rail and to the bottom rail at pivot joints 42. A latch 48 holds the siderail in a deployed position, which is the position seen in FIG. 1. A caregiver can release the latch and fold or collapse the siderail as seen in FIG. 2 (partially collapsed) FIG. 3 (almost completely collapsed) and FIGS. 4-5 (completely collapsed). The siderail is referred to as a collapsible siderail because it can be collapsed, as just described, in a plane P (FIG. 5) so that its collapsed height $h_C$ is considerably smaller than its deployed height $h_D$.

Figure 5:
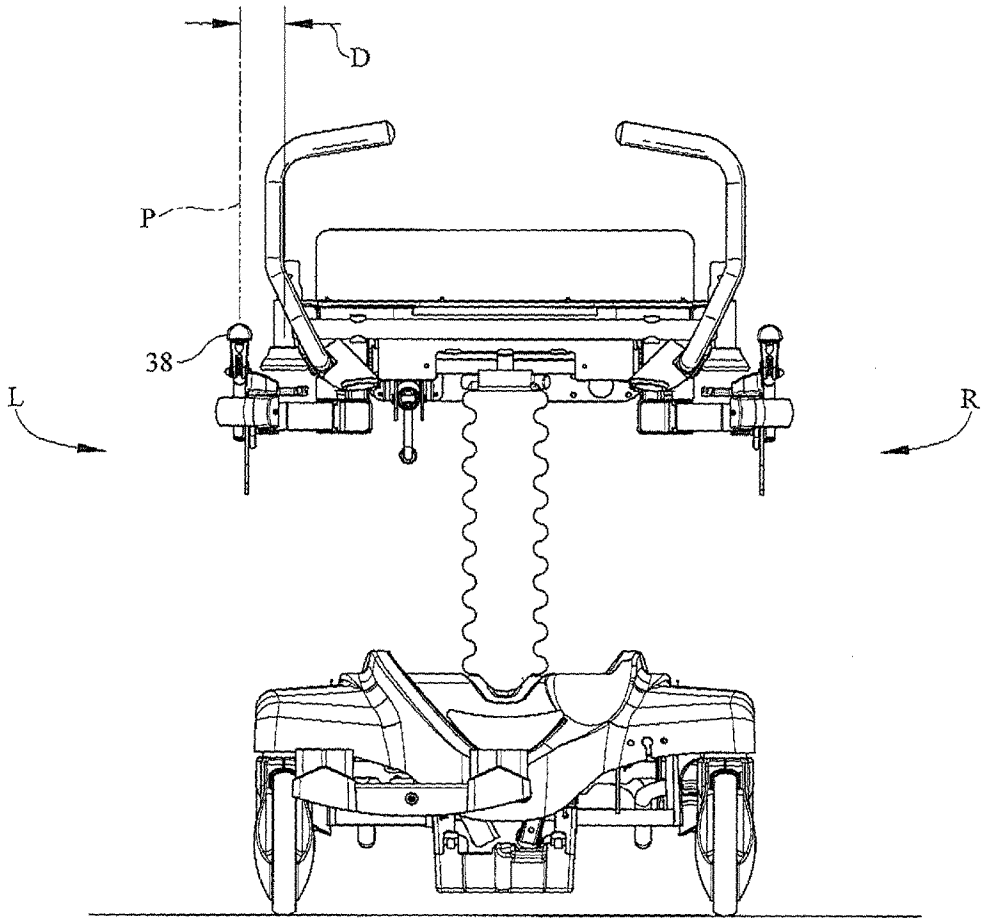
PRIOR ART FIG. 5
FIG. 5 is a head end elevation view showing the siderail completely collapsed as in FIG. 4.
Figure 6:
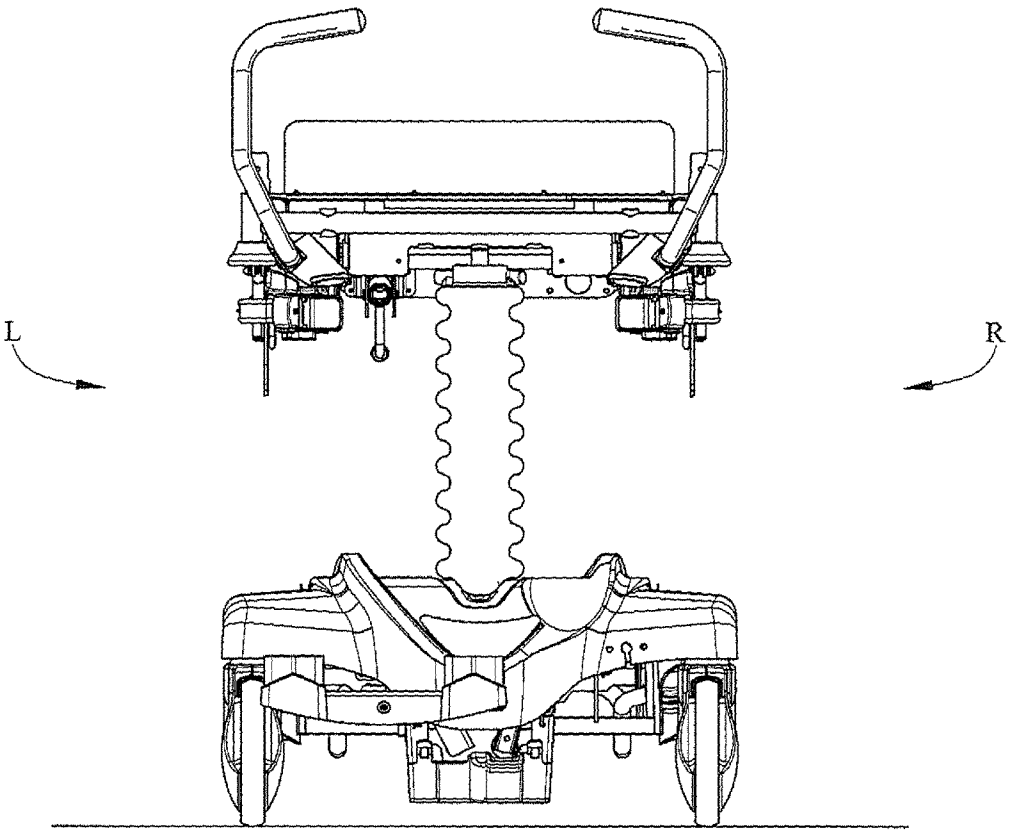
PRIOR ART FIG. 6
FIG. 6 is a view similar to that of FIG. 5 showing the siderail having been moved laterally inboard to a stowed position in which the siderail is underneath an elevatable frame of the stretcher and laterally inboard of the lateral edges of the stretcher.

Once collapsed, the siderail projects a distance D laterally outboard of the nearby lateral edge of the framework as seen best in FIG. 5. As seen in FIG. 6 the siderail can then be moved laterally inboardly to a stowed position underneath the elevatable frame. In the stowed position the siderail projects insignificantly or not at all beyond the edge of the framework. This allows the stretcher to be placed alongside another similarly designed stretcher so that with their adjacent siderails in the stowed positions there is essentially no gap between their mattresses. This condition is known as "zero gap" and enables the transfer of a patient from one stretcher to the other without any complications that might arise from the presence of an inter-mattress gap. Such a transfer is referred to as a "zero gap transfer".

Despite the merits of the collapsible siderail, it can give the impression of being flimsy due to the clearances necessary to accommodate relative motion at joints 42. In addition rods 40 can give the occupant of the stretcher the feeling of being caged. A siderail can be made more rigid and less cage-like by substituting a rigid panel for the rods. However without more, such a siderail would not be collapsible to a small height and therefore would not be as conveniently stowable in the manner just described. Accordingly, it is desirable to devise a siderail which is not only more rigid and less cage-like but which is also conveniently stowable.

FIGS. 7-10 show a bed in the form of a stretcher 60 embodying the inventive concepts disclosed herein. For reference selected illustrations include axes to show longitudinal, lateral, and vertical directions. Also for reference selected illustrations depict a longitudinally extending stretcher centerline CL and a stretcher centerplane CP.

Stretcher 60 extends longitudinally from a head end H to a foot end F and laterally from a left side L to a right side R. Like the prior art stretcher already described, the stretcher has a framework comprised of a base frame 62 and an elevatable frame 64 connected to the base frame by a height adjustment mechanism 66. The height adjustment mechanism can be operated to change the elevation of the elevatable frame relative to the base frame. The elevatable frame comprises a racetrack shaped inner rim 68 and a racetrack shaped outer rim 70 having a left side 72 and a right side 74 corresponding to left and right sides of the stretcher itself. Longitudinally distributed beams 76 span between the laterally opposite sides 72, 74 of the outer rim. The elevatable frame also includes a deck 78 whose upper surface defines a top surface 80 of the elevatable frame. The lower surfaces of the rim and beams define a notional bottom surface 82 of elevatable frame 64. The stretcher also includes a mattress 90 supported by the deck.

Figure 7:
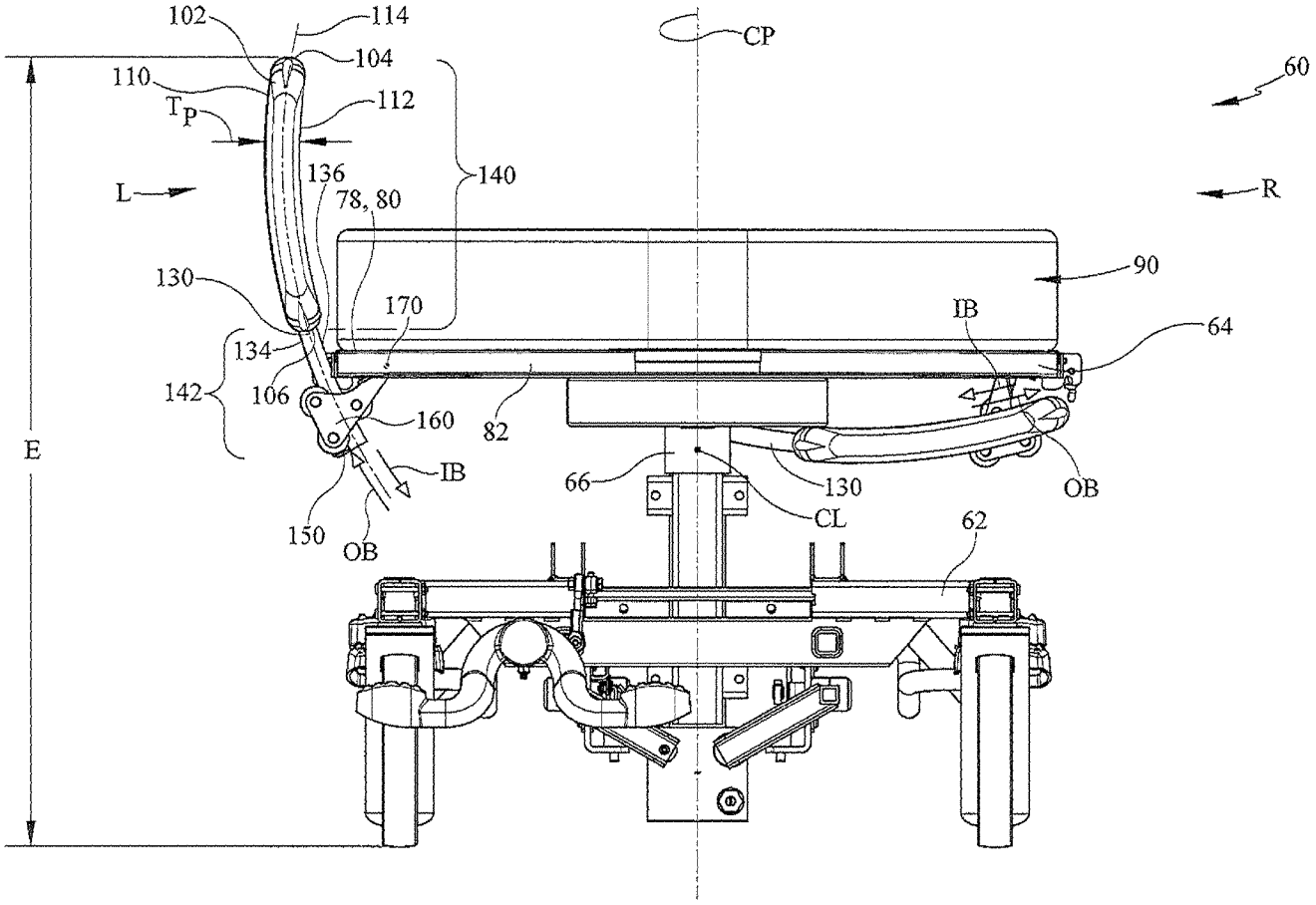
FIG. 7 is a head end elevation view of a stretcher having a stowable siderail assembly as described in more detail herein and showing a left siderail assembly in a deployed position and a right siderail assembly in a stowed position.
Figure 8:
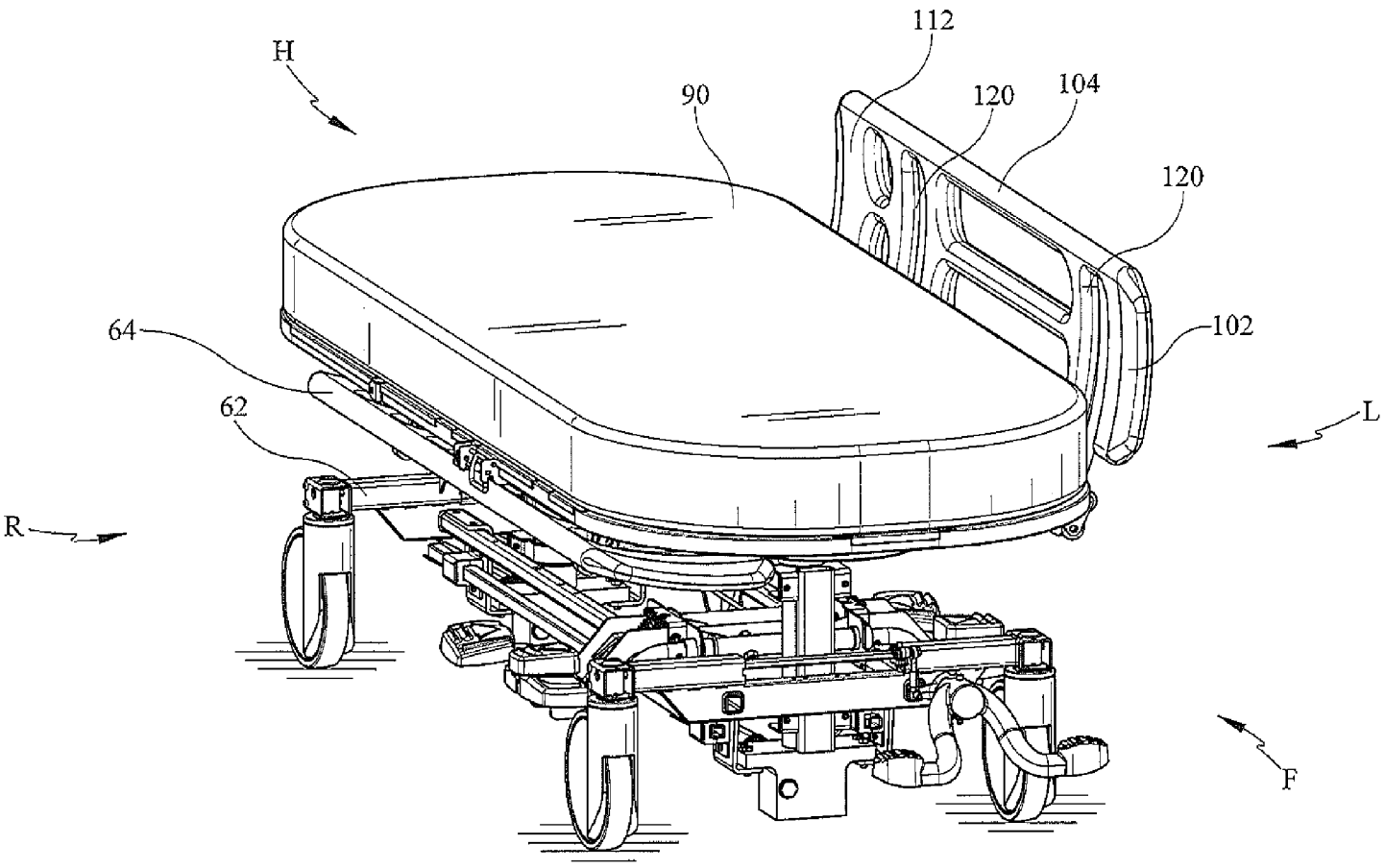
FIG. 8 is a perspective view of the stretcher of FIG. 7 as seen from the foot end of the stretcher.
Figure 9:
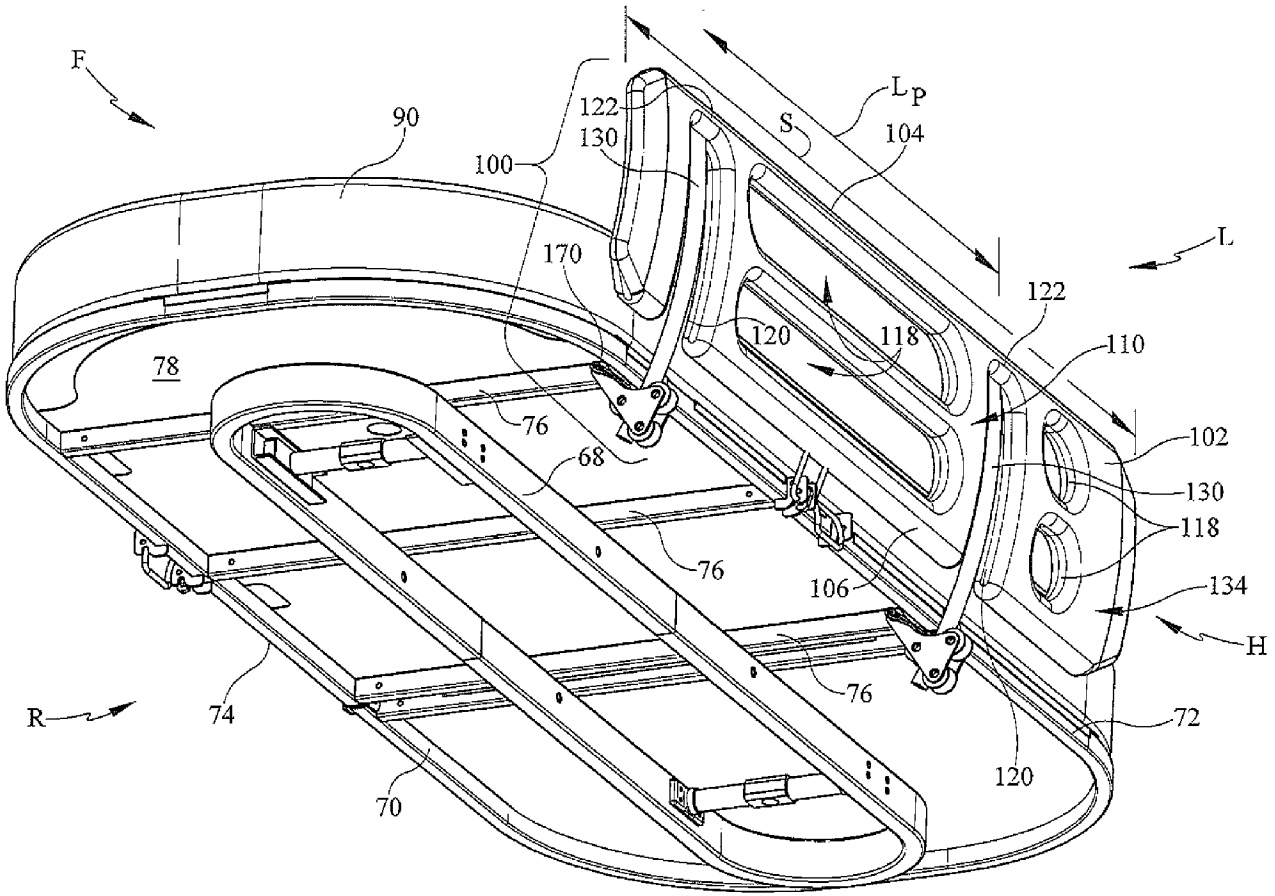
FIG. 9 is a perspective view of an elevatable frame of the stretcher as seen from underneath and with a siderail panel shown in a deployed position.
Figure 10:
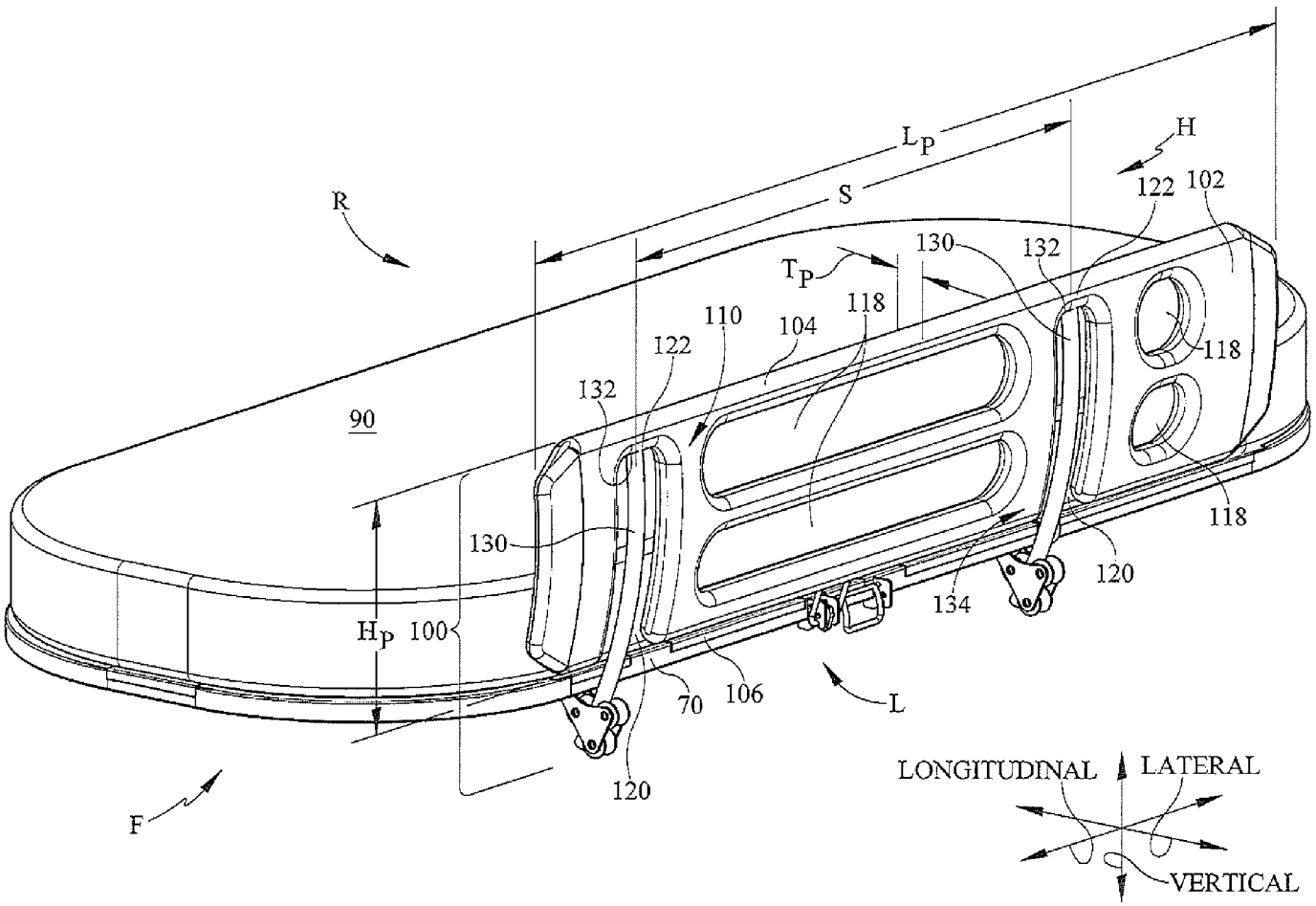
FIG. 10 is a perspective view similar to that of FIG. 9 but as seen from above.

The stretcher also includes a siderail assembly 100 comprised of a noncollapsible siderail panel 102 also referred to as simply a siderail. The panel has an upper edge 104, a lower edge 106, an outboard side 110 and an inboard side 112. The terms "inboard" and "outboard" are used herein to indicate relative proximity to centerline CL and centerplane CP in the lateral direction. The panel is referred to as noncollapsible because, unlike the prior art siderail of FIGS. 1-6, it cannot be collapsed to a more compact height. The outboard side of the panel is convex while the inboard side is concave. The convex and concave profiles give the panel an arcuate profile corresponding to arc 114 (FIG. 7). The panel has a length $L_P$ a height $H_P$ and a thickness $T_P$. Openings 118 may be provided to accommodate control interfaces or accessory devices or to give the stretcher occupant a sense of not being confined. The panel also includes a pair of full-thickness recesses 120, seen best in FIG. 10, which extend in the heightwise direction from lower edge 106 but not to upper edge 104, thereby defining bridges 122 along the top of the panel.

Figure 17:
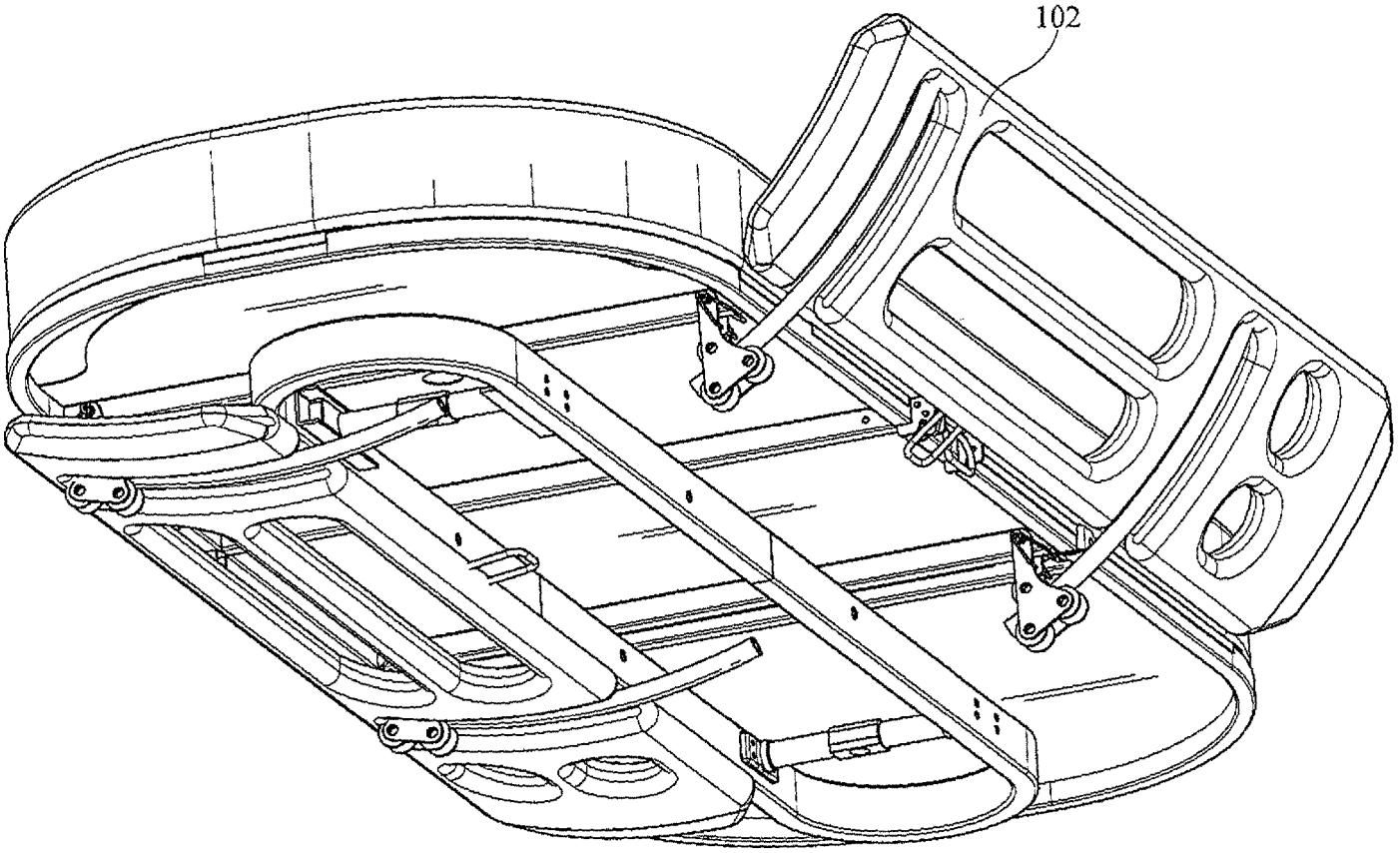
FIGS. 17 and 18 are views similar to those of FIGS. 9-10 but with the siderail panel in an intermediate position between the fully deployed position of FIGS. 9-10 and the fully stowed position of FIGS. 19-20.
Figure 18:
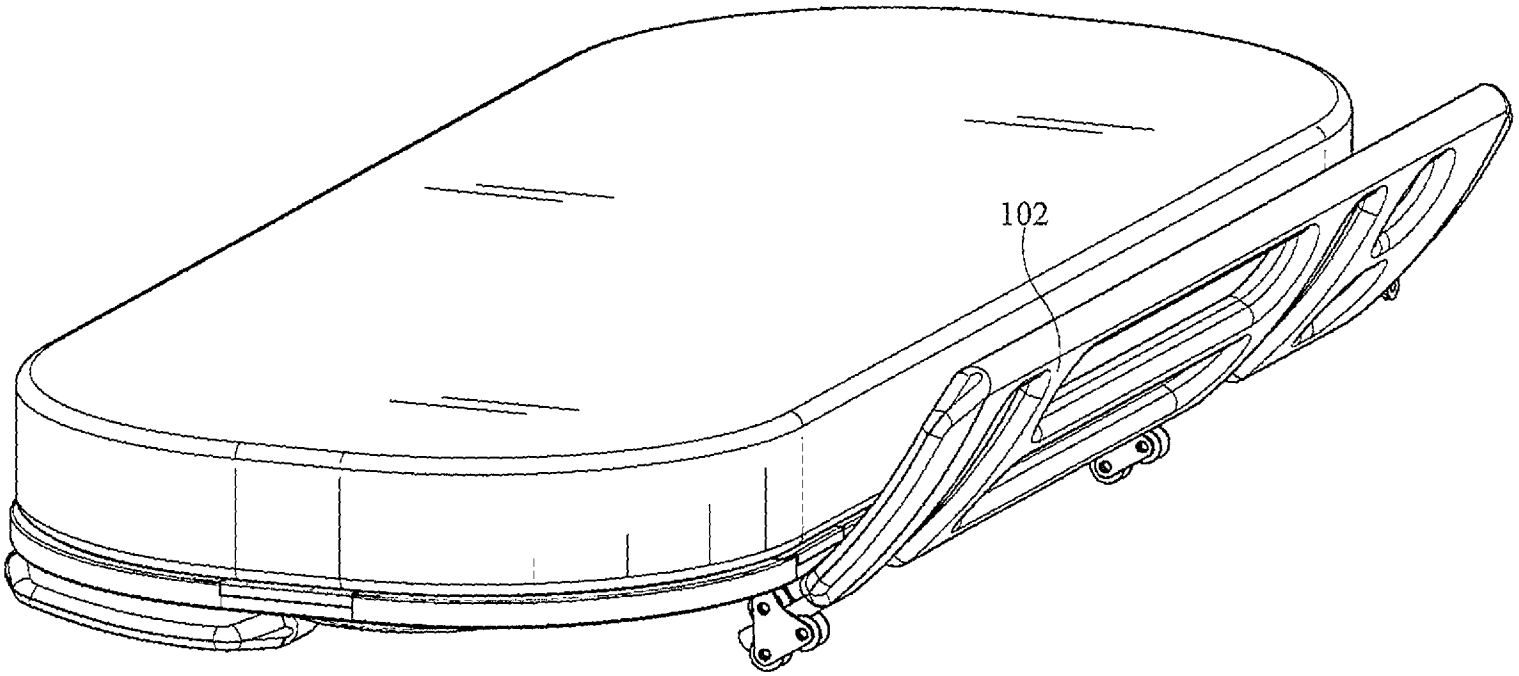
Figure 19:
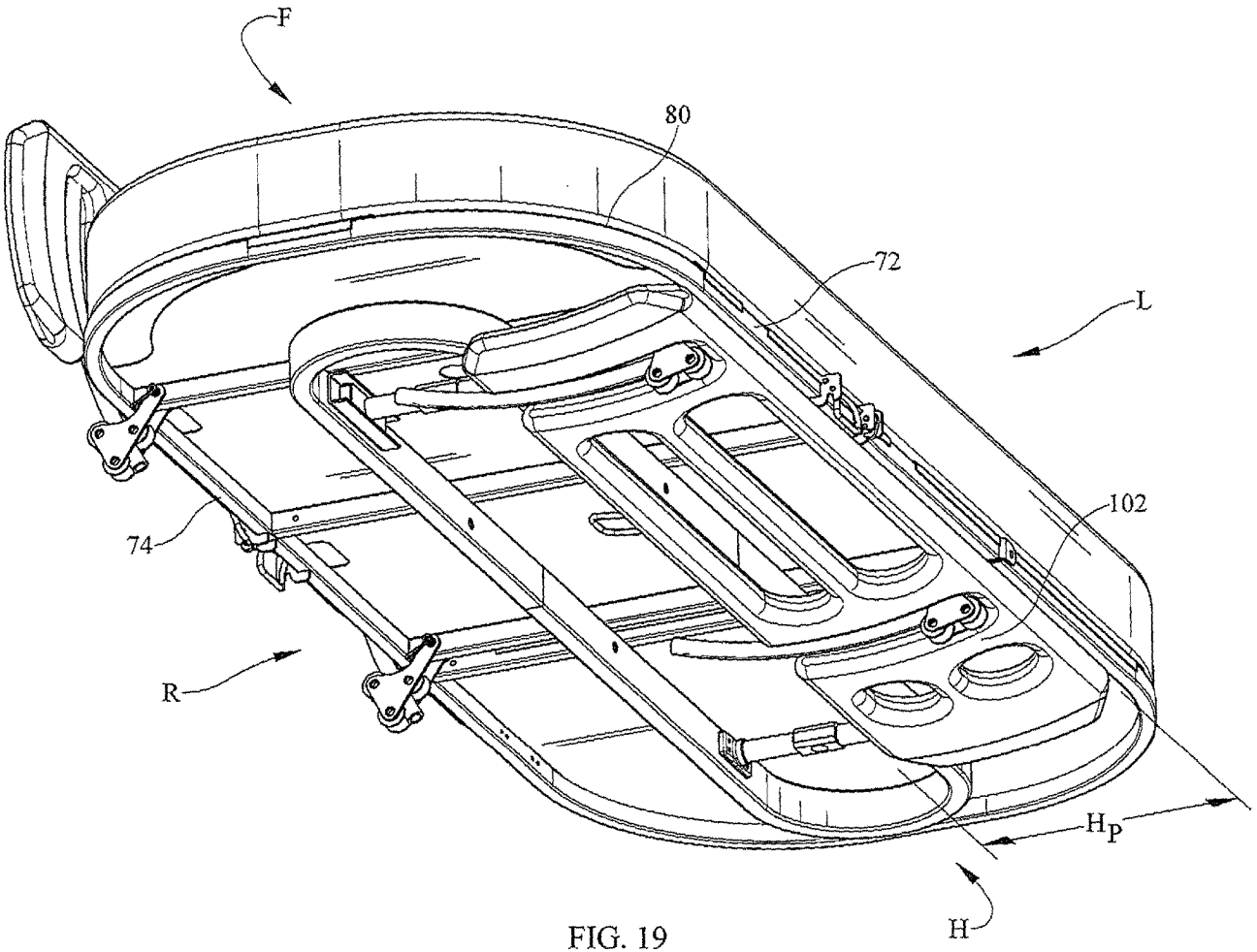
FIGS. 19 and 20 are views similar to those of FIGS. 9-10 but with the siderail panel in its fully stowed position.
Figure 20:
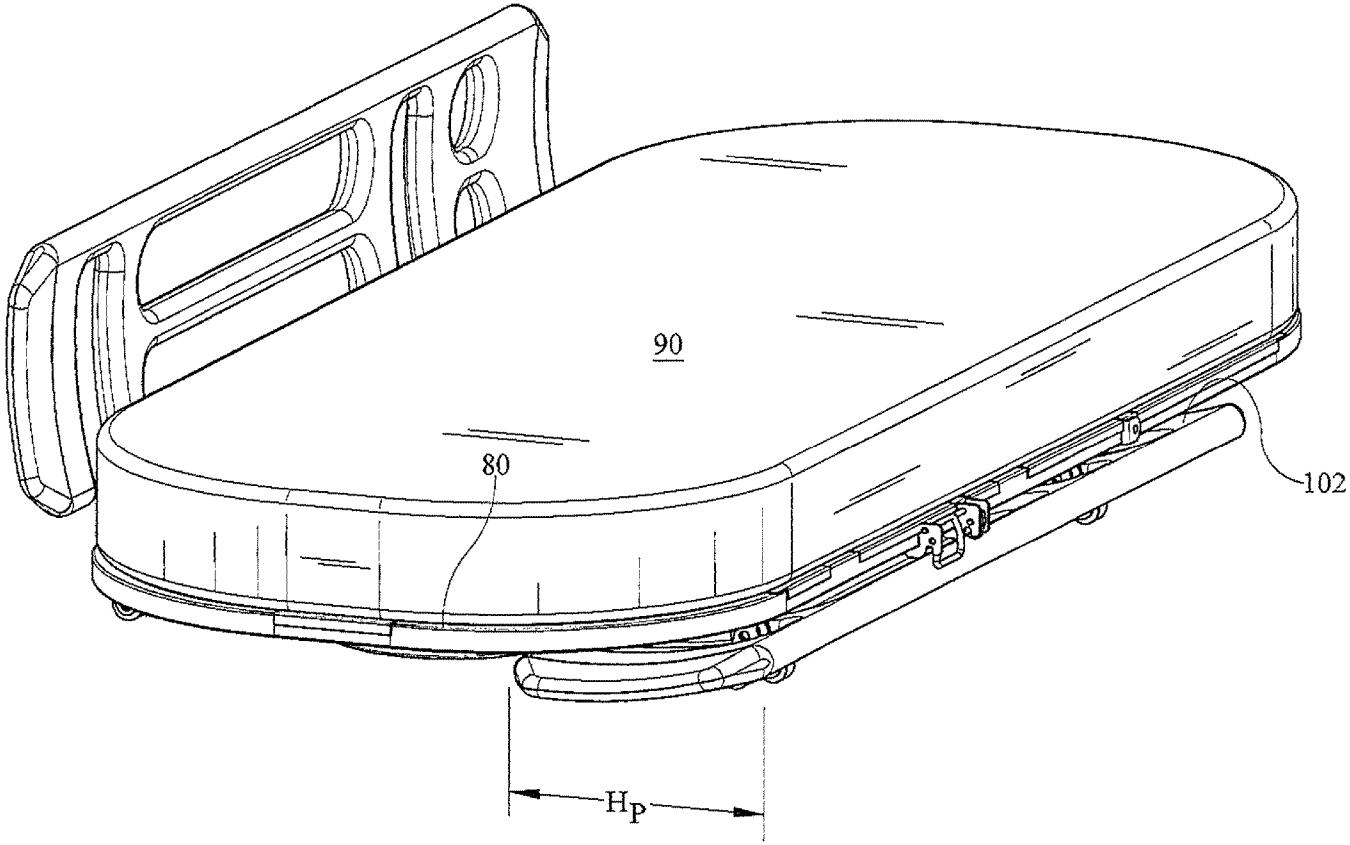

As will be described in more detail below siderail assembly 100, and therefore panel 102, can be moved between a deployed position (FIGS. 7-10) and a stowed position (FIGS. 19-20) by way of intermediate positions, one of which is shown in FIGS. 17-18. In this specification statements about movement between a deployed position and a stowed position or vice versa are not unidirectional statements, but instead encompass movement in both directions.

The siderail assembly also includes a pair of substantially identical guide rails 130 affixed to the panel at a juncture 132 in the vicinity of bridges 122 so that no relative motion occurs between the panel and the guide rails. Two guide rails separated by a considerable distance S are beneficial for stability, however in principle a single guide rail may be satisfactory. Moreover because the guide rails are substantially identical to each other it will suffice to describe only one guide rail. The guide rail, like panel 102, has a convex outboard side 134 and a concave inboard side 136 which give the guide rail an arcuate profile corresponding to arc 114. As seen best in FIG. 7 a first portion 140 of the guide rail is coextensive with the panel in the heightwise direction. A second portion 142 of the guide rail is an extension which extends past lower edge 106 of the panel and into a receptacle which is described below. The extension includes a catch, embodied as claw 150, near the end of the guide rail remote from panel 102.

Figure 11:
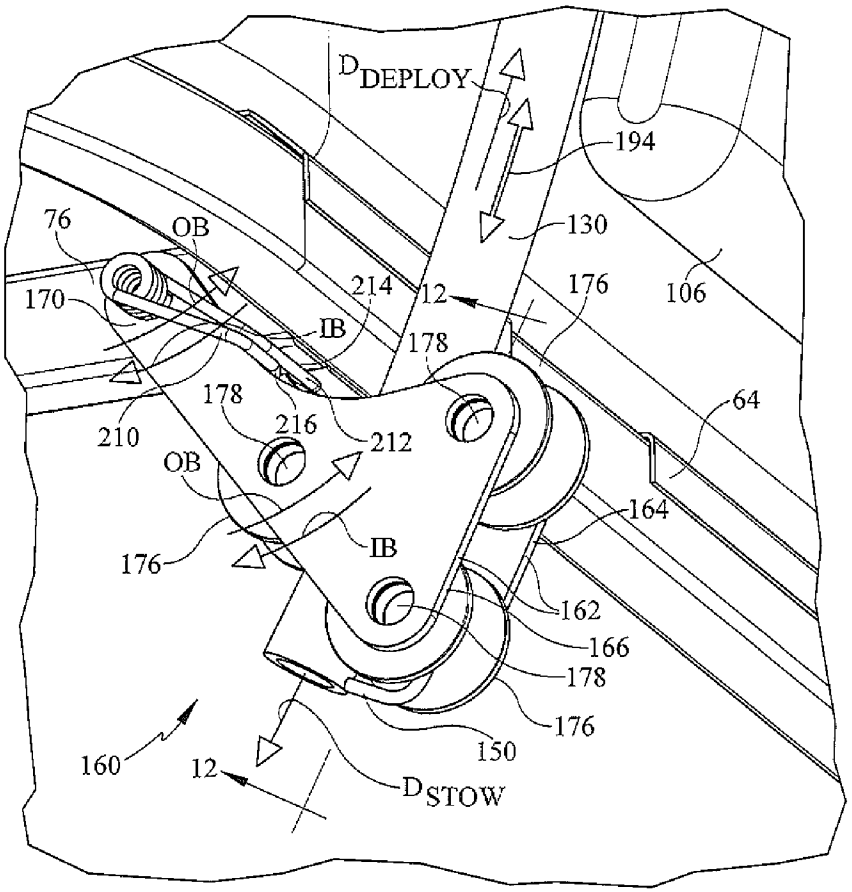
FIG. 11 is a perspective view of a link component of the stowable siderail assembly.
Figure 12:
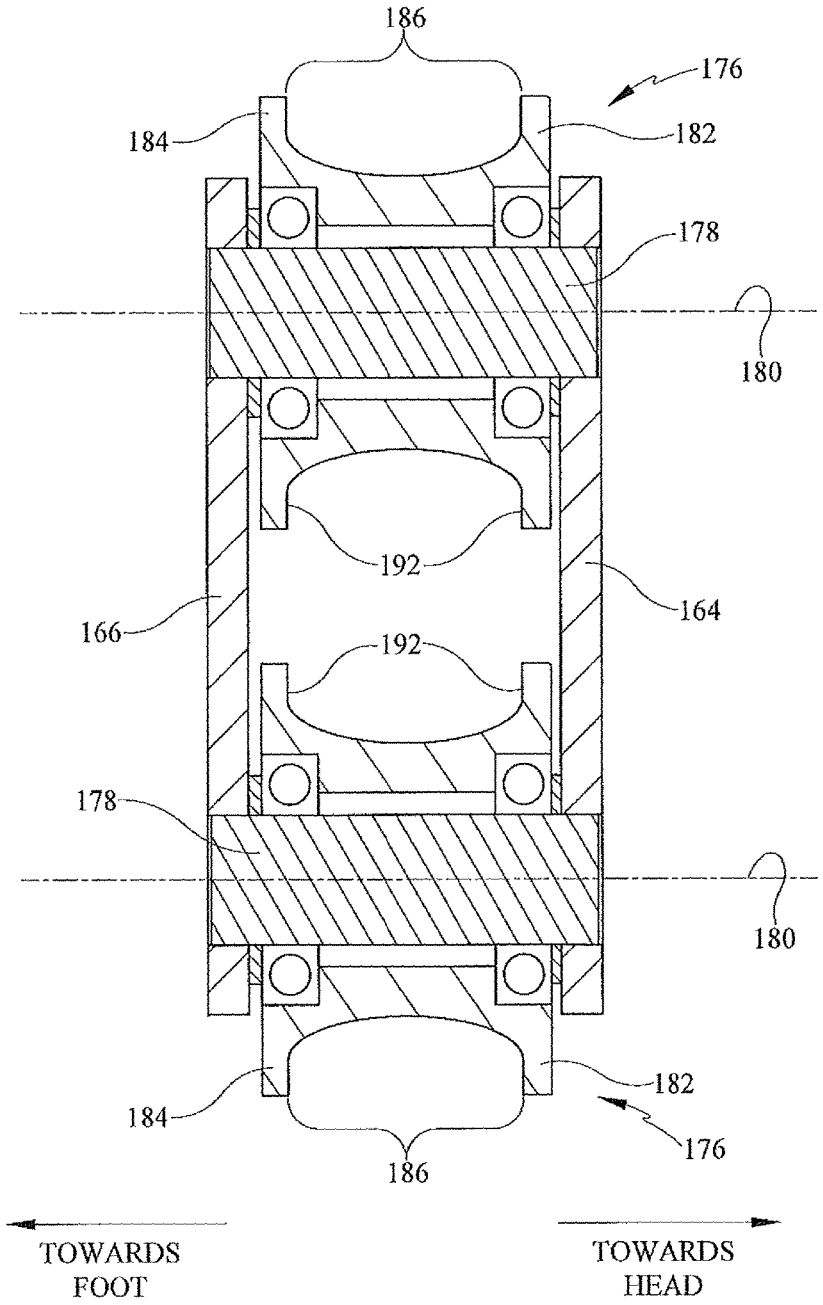
FIG. 12 is a schematic view of the link taken in the direction 12-12 of FIG. 11.
Figure 13:
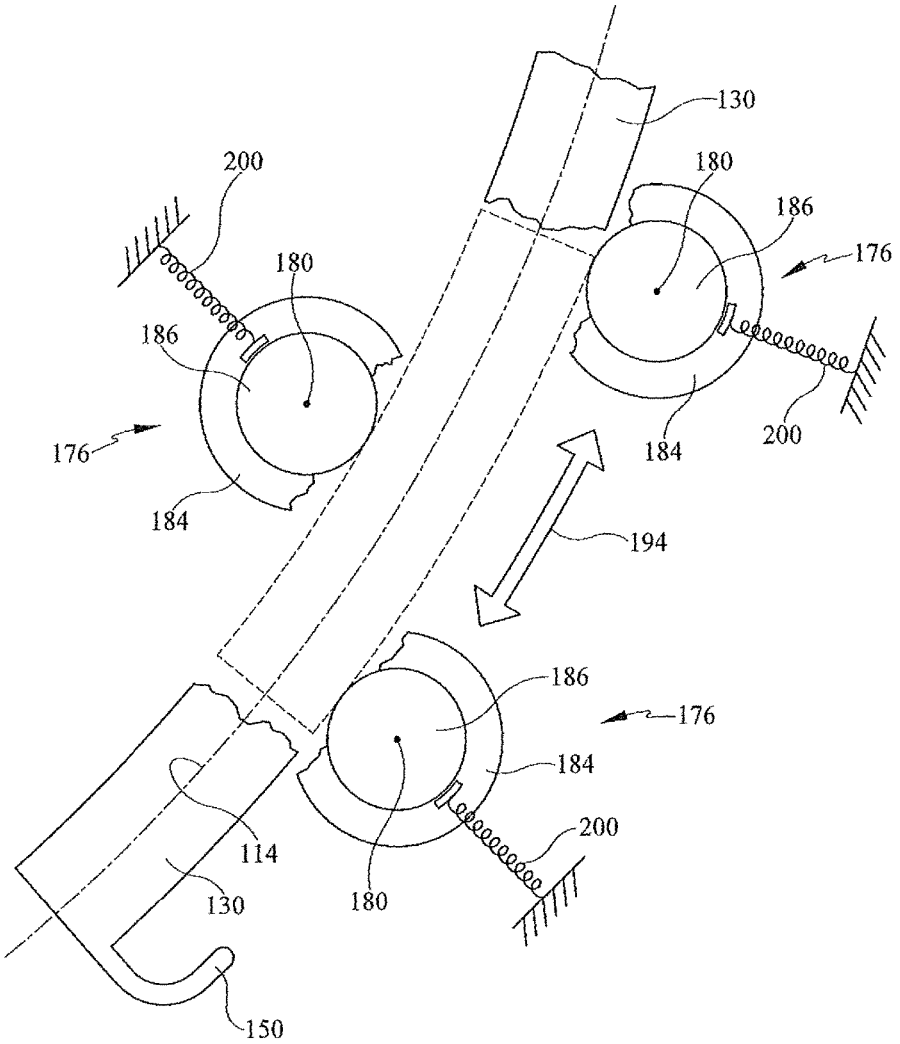
FIG. 13 is a side elevation view of the link of FIG. 12 with selected features removed or broken away to show a receptacle defined by roller flanges and roller drums.

Referring additionally to FIGS. 11-13 the siderail assembly also includes a link 160. The link includes a housing 162 comprised of a head housing plate 164 and a foot housing plate 166 longitudinally spaced from the head plate. The plates are pivotably mounted on beam 76 of elevatable frame 64 at pivot 170. A set of guides is mounted on the housing. The illustrated guides are rollers 176 which are each rotatably mounted on the housing by a pin 178 so that the rollers extend longitudinally between the head and foot plates Each roller is rotatable about a rotational axis 180. Each roller includes a head flange 182 having a head flange diameter, a foot flange 184 having a foot flange diameter and a drum 186 having a drum diameter smaller than the smaller of the flange diameters, which are illustrated as being equal to each other. The guides are spaced from each other to define a receptacle. In the illustrated embodiment the roller axes, and therefore the drums, are spaced from each other to define an interroller receptacle 190. The receptacle is essentially the volume bounded by inner faces 192 of the roller flanges and the roller drums 186 as depicted by the dashed outline in FIG. 13.

The interroller receptacle 190 receives the extension portion 142 of guide rail 130. The link is configured to receive the extension so that the link grips the extension and concurrently permits translation of the guide rail through the receptacle and therefore relative to the link. In particular, the spacing of the rollers is calibrated to grip the extension tightly enough to resist undue wobbling of the guide rail(s) and panel, but loosely enough to permit translation of the guide rail relative to the link in the direction indicated by double-headed arrow 194. Force exerting elements such as a roller springs 200 mechanically grounded to the housing may be included to exert a force on the rollers which helps to achieve the desired balance of gripping force and rail translatability and to maintain a suitable balance despite the effects of manufacturing inaccuracies and deterioration over the life of the product. In the illustrated example the force acts in a direction that tends to urge each roller in a direction toward the guide rail. Spring 200 is referred to as a roller spring to distinguish it from a link spring described below.

In the illustrated embodiment link 160 includes three rollers 176. The drums 186 of two of the rollers are on the outside or convex side of profile arc 114. The drum of the other roller is on the inside or concave side of profile arc 114.

In the foregoing paragraphs the guides are exemplified as rollers 176, however other types of guides, such as nonrotatable blocks which the guide rails slide along may also be satisfactory.

The siderail assembly also includes a link spring 210. Spring 210 is referred to as a link spring to distinguish it from the aforementioned roller spring 200. Link spring 210 has a grounded end 212 mechanically grounded to the frame, for example by a weld or braze joint 214, and a free end 216. The free end 216 of link spring 210 bears against the link during at least part of travel of the siderail panel between a deployed position in which the upper edge of the panel is at an elevation higher than that of the top surface and a stowed position in which substantially all of the height of the panel resides beneath the top surface and laterally inboard of the lateral sides of outer rim 70. Because the spring bears against the link, the spring exerts a force tending to rotate the link in an inboard rotational sense IB (FIGS. 7, 11) about pivot 170 and tending to resist rotation of the link in an outboard rotational sense OB.

Figure 14:
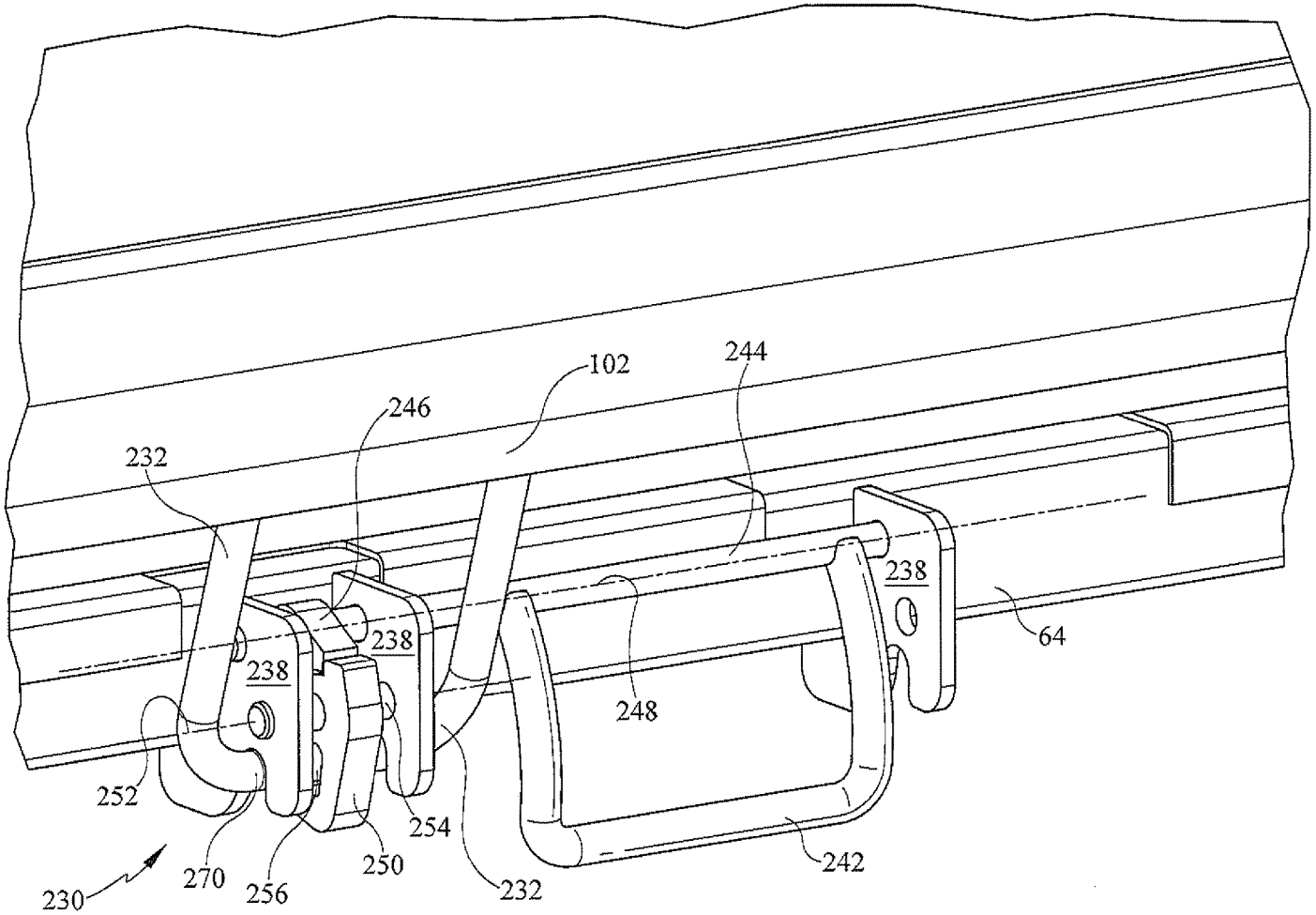
FIG. 14 is a perspective view of a siderail latch in its latched position.
Figure 15:
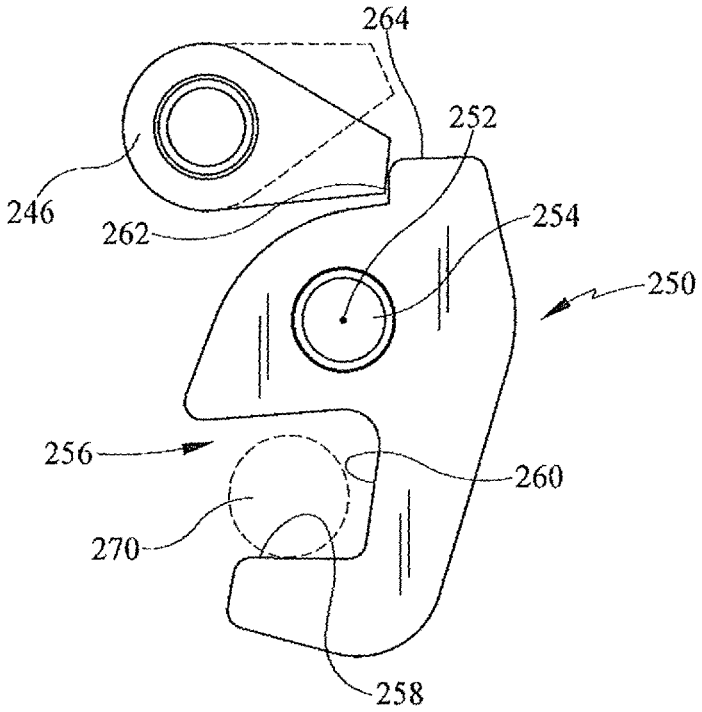
FIG. 15 is a schematic elevation view of selected elements of the latch of FIG. 14 in its latched position.
Figure 16:
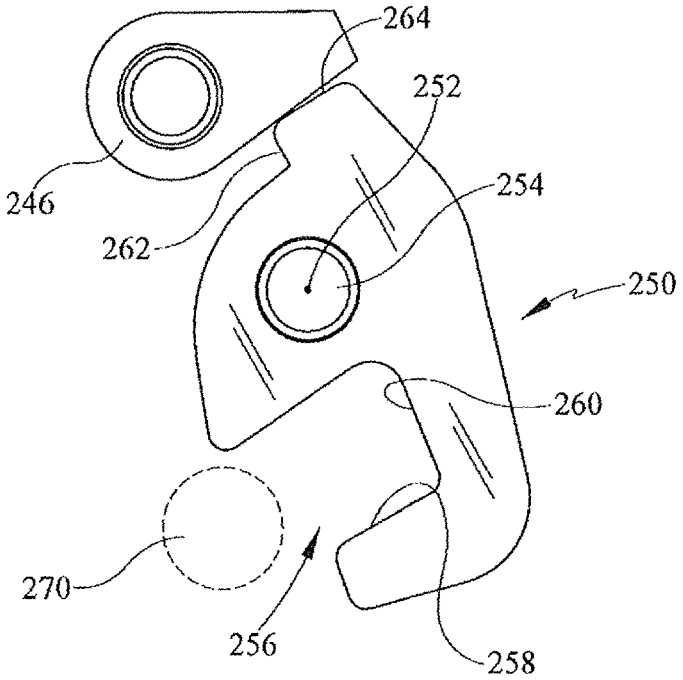
FIG. 16 is a schematic elevation view of selected elements of the latch of FIG. 14 in an open or unlatched position.

Referring additionally to FIGS. 14-16, the stretcher also includes a siderail latch 230 comprising a stator 232 secured to the bottom of panel 102 and a hook assembly. The hook assembly includes a triplet of brackets 238 immovably secured to elevatable frame 64 and a release unit having a handle 242, a shaft 244 and a buttress 246. The handle, shaft and buttress are rotatable as a unit about shaft axis 248. The position of handle 242 as seen in FIG. 14 is referred to as the neutral position of the handle. The shaft is rotatably journaled in holes in the brackets so that the buttress is nested between two of the brackets. The hook assembly also includes a hook 250 mounted on a pin 254 which is rotatably journaled in openings in the same two brackets. The pin and hook rotate as a unit about axis 252. The hook includes an inwardly facing notch 256 having a ledge 258 and a curved back surface 260. The hook also includes a shoulder 262 and a tip 264. As seen by comparing FIG. 15 to FIG. 16 the hook is rotatable between a latched state (FIG. 15, and also FIG. 14) and an unlatched or open state (FIG. 16). The hook is spring loaded or otherwise biased to rotate it to its open state. In the latched state horizontal leg 270 of stator 232 rests on hook ledge 258 (leg 270 is shown in phantom in FIGS. 15-16). In addition hook shoulder 262 bears against buttress 246 to prevent the hook from rotating to the open state. When a user wishes to open the latch she pulls up on handle 242 which rotates buttress 246 out of contact with hook shoulder 262 as seen in phantom in FIG. 15. The hook, under the influence of the previously mentioned rotational bias, rotates to its open state of FIG. 16 so that leg 270 of stator 232 no longer rests on ledge 258. The user can then release the handle which rotates back to its neutral position of FIG. 14. As a result of these actions the underside of buttress 246 rests on hook tip 264 as seen in FIG. 16 and, because the latch is now open, the siderail assembly can move toward its stowed position.

In operation, when a user unlatches the siderail assembly, link spring 210 rotates link 160 in inboard rotational sense IB about pivot 170. The roller closest to claw 150 engages the claw so that the link assists in drawing the guide rail and the panel toward their stowed position seen in FIGS. 19-20. The user may exert an opposing force to regulate the speed at which the guide rails and panel move toward the stowed position. When the link has undergone its maximum possible rotation in the inboard rotational sense IB, the link no longer assists with movement of the panel toward its stowed position, however a caregiver can push the guide rails increasingly into the receptacle until the panel is in its fully deployed position of FIGS. 19-20. As used herein, "increasingly into" means that the guide rail moves through the receptacle in direction $D_{STOW}$ and the panel also moves in direction $D_{STOW}$ seen in FIG. 11. While the link is translating through the receptacle the rollers continue to grip the guide rails, however their grip is loose enough to permit the user to guide the siderail assembly, including panel 102, in the laterally inboard direction so that the guide rail translates increasingly into the receptacle.

When a user wishes to deploy a stowed siderail assembly she grasps panel 102 at any convenient location and pulls the siderail assembly in an outboard direction away from centerline CL. The link rollers continue to grip the guide rails, however their grip is loose enough to permit the user to guide the siderail assembly in the laterally outboard direction so that the the guide rail translates increasingly out of receptacle 190. As used herein, "increasingly out of" means that the guide rail moves through the receptacle in direction $D_{DEPLOY}$ and the panel also moved in direction $D_{DEPLOY}$ seen in FIG. 11. When the guide rail has translated sufficiently far in the outboard direction, claw 150 engages the roller closest to the claw causing the link to rotate in the outboard rotational sense OB about pivot 170 toward the deployed position. Because link spring 210 is biased to exert a force on the link in a direction to assist stowage, the spring will offer resistance to further outboard rotation of the link and panel. The user will have to overcome the resistance in order to effect deployment. The engagement of the claw with the roller also precludes withdrawal of the guide rail extension from the receptacle.

As the user moves the siderail back to the deployed position, horizontal stator leg 270 contacts the curved surface 260 of notch 256. The curvature of the surface is such that additional movement of the siderail toward the deployed position causes leg 270 to counterrotate hook 250 back to its latched state with ledge 258 beneath stator horizontal leg 270 and therefore positioned to support the horizontal leg. In addition buttress 246 drops off tip 264 of hook 250 so it can once again engage hook ledge 262 and resist rotation of the hook toward its open state. The siderail is now in its fully deployed and latched state. Because the link spring continues to exert a force tending to move the panel toward its stowed position, the spring urges the stator against the ledge thereby reinforcing the engagement between the hook and the panel.

The guide rail is capable of undergoing travel between a deployed position (e.g. FIGS. 7-10) and a stowed position (FIGS. 19-20) by way of intermediate positions, one of which is shown in FIGS. 17-18. As a result the panel is movable between a deployed position (e.g. FIGS. 7-10) and a stowed position (FIGS. 19-20) as a result of moving or traveling through the intermediate positions. In the deployed position at least a portion of the panel extends to an elevation E (FIG. 7) higher than that of the top surface 80 of elevatable frame 64. In the stowed position substantially all of the panel resides below top surface 80 and laterally inboard of lateral sides 72, 74 of outer rim 70. When the siderail assembly is in the stowed position substantially all of the height or heightwise dimension $H_P$ of the panel resides beneath the top surface. Because the stowed siderail does not project laterally beyond sides 72, 74 of the frame, two stretchers having the disclosed stowable siderail can be brought next to each other with their adjacent siderails stowed and achieve the "zero gap" and "zero gap transfer capability described previously.

Figure 21:
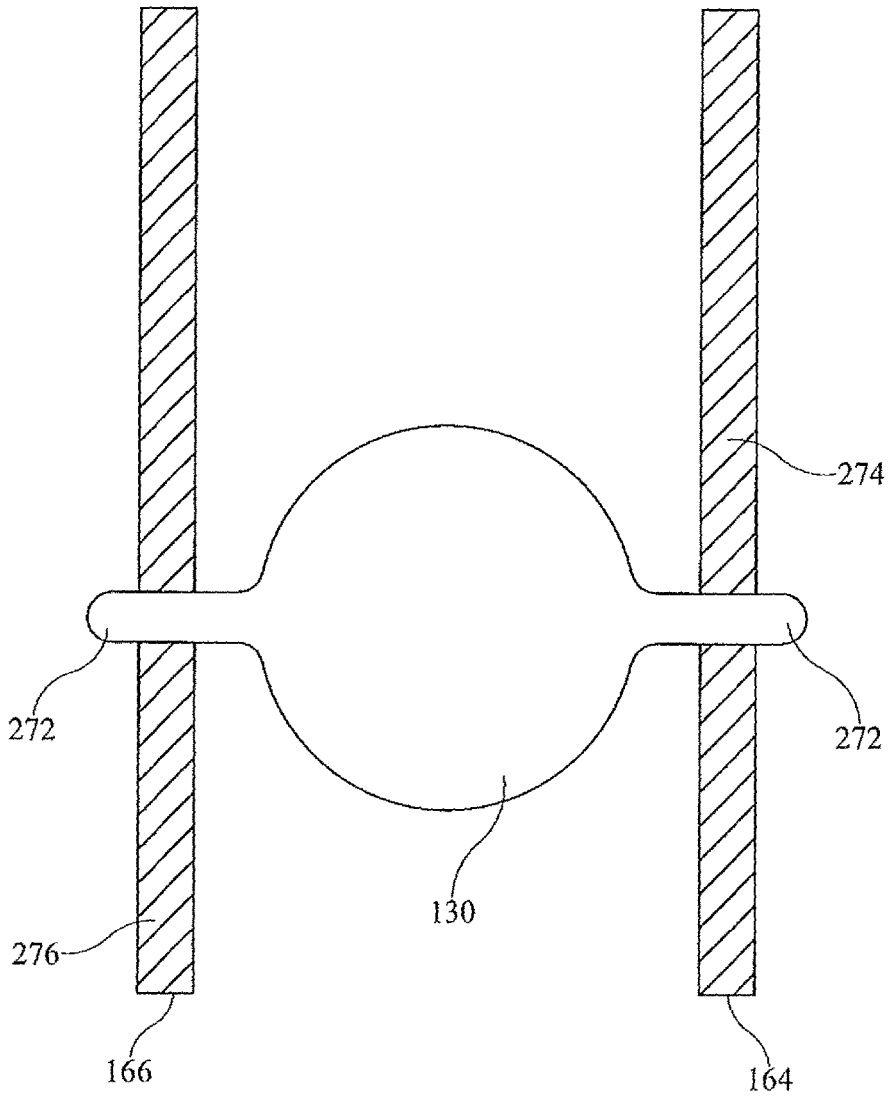
FIG. 21 is a schematic view of the edges of a pair of mounting plates and the remote end of a guide rail having longitudinally projecting lugs.

As already noted catch 150 may take a form other than that of the illustrated claw. FIG. 21 shows one example alternative which includes a pair of lugs 272 that project longitudinally from the remote end of the guide rail in the headward and footward directions. The lugs are long enough to engage edges 274, 276 of the housing plates. Irrespective of the form of the catch it is configured to preclude withdrawal of the extension from the receptacle when the panel is moved from its stowed position toward its deployed position, to transfer pivotal motion of the link to the guide rails and therefore to the panel during stowage of the siderail, and to transfer motion of the siderail to the link during deployment of the siderail.

We claim:

1. A bed comprising:

a frame; and a siderail assembly comprised of:

a noncollapsible siderail panel having an upper edge and a lower edge and which is movable toward a stowed position and toward a deployed position;

a guide rail affixed to the panel and having an extension which extends past the lower edge of the panel; and a link pivotably mounted on the frame the link being rotatable in an inboard rotational sense and an outboard rotational sense, the link configured to receive the extension so that the link grips the extension and permits translation of the guide rail relative to the link, and wherein the link is spring biased so that it:

assists panel movement toward the stowed position over at least part of the movement of the panel toward the stowed position; and resists panel movement toward the deployed position over at least part of the movement of the panel toward the deployed position.

2. The bed of claim 1 wherein:

panel movement toward the stowed position is accompanied by inboard rotation of the link over at least part of the movement of the panel toward the stowed position; and panel movement toward the deployed position is accompanied by outboard rotation of the link over at least part of the movement of the panel toward the deployed position.

3. The bed of claim 1 wherein the guide rail includes a catch configured to transfer motion of the panel to the link when the panel is moved toward the deployed position and to transfer motion of the link to the panel when the panel is moved toward the stowed position.

4. The bed of claim 1 wherein when the panel moves toward the stowed position the link rotates in the inboard rotational sense during at least part of the panel movement toward the stowed position, and when the panel moves toward the deployed position the link rotates in the outboard rotational sense during at least part of the panel movement toward the deployed position.

5. The bed of claim 1 wherein the frame has a top surface and the deployed position is a position in which at least a portion of the panel extends to an elevation higher than that of the top surface and the stowed position is a position in which substantially all of the panel resides beneath the top surface.

6. The bed of claim 1 wherein the frame has a top surface, a left lateral side and a right lateral side and the deployed position is a position in which at least a portion of the panel extends to an elevation higher than that of the top surface and the stowed position is a position in which substantially all of the panel resides below the top surface and laterally inboard of the lateral sides.

7. The bed of claim 1 wherein the guide rail has an arcuate profile.

8. The bed of claim 1 wherein the panel has an outboard side and an inboard side, the inboard side having a concave profile.

9. The bed of claim 1 wherein the link comprises:

a housing; and a set of guides mounted on the housing, the guides being spaced from each other to define a receptacle which receives the extension.

10. The bed of claim 9 wherein the guide rail includes a catch configured to preclude withdrawal of the extension from the receptacle.

11. The bed of claim 9 wherein when the panel moves toward the stowed position the guide rail translates increasingly into the receptacle and when the panel moves toward the deployed position the guide rail translates increasingly out of the receptacle.

12. The bed of claim 9 wherein the set of guides is a set of rollers each roller having a drum, the drums being spaced from each other so that the rollers define the receptacle.

13. The bed of claim 12 wherein the link grips the extension and permits translation of the guide rail relative to the link as a result of spacing of the rollers.

14. The bed of claim 12 wherein each set of rollers is three rollers and wherein the drums of two of the rollers are on the outside of an arc of the guide rail and panel, and the drum of the other of the rollers is on the inside of the arc.

15. The bed of claim 1 wherein translation of the guide rail relative to the link comprises translation of the guide rail extension through the link.

16. The bed of claim 1 wherein the guide rail comprises a first portion which is coextensive with the panel in a heightwise direction, and wherein the extension is a second portion of the siderail.

17. A bed comprising:

a frame having a top surface, a left lateral side and a right lateral side;

a siderail assembly comprised of:

a noncollapsible arcuately profiled siderail panel having an upper edge and a lower edge;

a link pivotably mounted on the frame, the link comprised of:

a head housing plate and a foot housing plate longitudinally spaced from the head housing plate, the housing plates pivotably mounted on the frame, and a set of rollers each roller having a rotational axis, the rollers mounted on and extending between the housing plates with the axes spaced from each other to define an interroller receptacle;

an arcuate guide rail affixed to the panel and having an extension which extends past the lower edge of the panel and into the receptacle so that the receptacle receives the extension;

a link spring having a ground end grounded to the frame and a free end arranged to bear against the link during at least part of travel of the siderail panel between a deployed position in which the upper edge of the panel is at an elevation higher than that of the top surface and a stowed position in which substantially all of the panel resides beneath the top surface and laterally inboard of the lateral sides and wherein the spring exerts a force which assists rotation of the link in an inboard rotational sense during at least part of the travel toward the stowed position and resists rotation of the link in an outboard rotational sense during at least part of the travel toward the deployed position.

18. A bed comprising:

a frame; and a siderail assembly comprised of:

a noncollapsible siderail panel having an upper edge and a lower edge;

a guide rail affixed to the panel and having an extension which extends past the lower edge of the panel;

wherein the guide rail is capable of undergoing travel between a stowed position and a deployed position, and wherein the bed includes a link spring having a ground end grounded to the frame and a free end arranged to bear against the link during at least part of the travel.

19. The bed of claim 18 wherein the link spring exerts a force that assists rotation of the link in an inboard rotational sense during at least part of the travel toward the stowed position and resists rotation of the link in an outboard rotational sense during at least part of the travel toward the deployed position.

20. A bed comprising:

a frame;

a siderail assembly comprised of:

a noncollapsible siderail panel having an upper edge and a lower edge;

a guide rail affixed to the panel and having an extension which extends past the lower edge of the panel; and a link pivotably mounted on the frame, the link comprising a housing and a set of guides mounted on the housing and spaced from each other, each guide comprised of a set of rollers, each of which has a drum, the drums spaced from each other so that the rollers define a receptacle configured to receive the extension so that the link grips the extension and permits translation of the guide rail relative to the link; and a force exerting element which exerts a force tending to urge each roller in direction toward the guide rail.

21. A bed comprising:

a frame;

a siderail assembly comprised of:

a noncollapsible siderail panel having an upper edge and a lower edge;

a guide rail affixed to the panel and having an extension which extends past the lower edge of the panel; and a link pivotably mounted on the frame, the link comprising a housing and a set of guides mounted on the housing and spaced from each other, each guide comprised of a set of rollers, each of which has a drum, the drums spaced from each other so that the rollers define a receptacle configured to receive the extension so that the link grips the extension and permits translation of the guide rail relative to the link; and a force exerting element which exerts a force which helps to achieve a balance of gripping force and guide rail translatability.

22. A bed comprising:

a frame;

a siderail assembly comprised of:

a noncollapsible siderail panel having an upper edge and a lower edge;

a guide rail affixed to the panel and having an extension which extends past the lower edge of the panel;

a link pivotably mounted on the frame, the link configured to receive the extension so that the link grips the extension and permits translation of the guide rail relative to the link; and a latch comprised of:

a stator secured to the panel; and a hook assembly secured to the frame, the hook assembly comprising a rotatable hook having a ledge and a shoulder, and a release unit having a buttress, the hook assembly having an engaged state in which the stator rests on the ledge and the shoulder bears against the buttress to prevent the hook from rotating to an open state thereby latching the siderail panel in its deployed position, and a disengaged state in which the stator does not rest on the ledge and the shoulder does not bear against the buttress thereby rendering the panel movable toward the stowed position.

23. The bed of claim 22 including:

a link spring having a ground end grounded to the frame and a free end arranged to bear against the link when the panel is in the deployed position so that the spring exerts a force on the link which urges the stator against the ledge.

* * * * *